US006622707B2

(12) United States Patent
Begley et al.

(10) Patent No.: US 6,622,707 B2
(45) Date of Patent: Sep. 23, 2003

(54) ELECTRONIC RETURNLESS FUEL SYSTEM

(75) Inventors: Chris Clarence Begley, Ortonville, MI (US); Michael D. Lutton, Grand Blanc, MI (US); Michael Joseph Niemiec, Brighton, MI (US); Charles Wilson Braun, Livonia, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/878,094

(22) Filed: Jun. 8, 2001

(65) Prior Publication Data

US 2002/0020397 A1 Feb. 21, 2002

Related U.S. Application Data

(60) Provisional application No. 60/214,509, filed on Jun. 28, 2000.

(51) Int. Cl.[7] ..... F02M 37/04

(52) U.S. Cl. ..... 123/497; 123/514

(58) Field of Search ..... 123/497, 514, 123/516, 509, 510

(56) References Cited

U.S. PATENT DOCUMENTS

| | | | | | |
|---|---|---|---|---|---|
| 4,926,829 | A | | 5/1990 | Tuckey | |
| 5,044,344 | A | | 9/1991 | Tuckey et al. | |
| 5,074,272 | A | * | 12/1991 | Bostick et al. | 123/514 |
| 5,133,323 | A | * | 7/1992 | Treusch | 123/494 |
| 5,148,792 | A | * | 9/1992 | Tuckey | 123/497 |
| 5,237,975 | A | | 8/1993 | Betki et al. | |
| 5,379,741 | A | | 1/1995 | Matysiewicz et al. | |
| 5,398,655 | A | * | 3/1995 | Tuckey | 123/456 |
| 5,448,977 | A | | 9/1995 | Smith et al. | |
| 5,692,479 | A | * | 12/1997 | Ford et al. | 123/514 |
| 5,701,869 | A | * | 12/1997 | Richardson et al. | 123/497 |
| 5,732,684 | A | | 3/1998 | Thompson | |
| 5,743,239 | A | | 4/1998 | Iwase | |
| 5,749,345 | A | | 5/1998 | Treml | |
| 5,791,317 | A | * | 8/1998 | Eck | 123/510 |
| 5,794,597 | A | * | 8/1998 | Schwegler et al. | 123/514 |
| 5,848,583 | A | | 12/1998 | Smith et al. | |
| 5,967,120 | A | * | 10/1999 | Blanton et al. | 123/467 |
| 6,164,325 | A | | 12/2000 | Braun | |
| 6,293,256 | B1 | | 9/2001 | Kleppner et al. | |
| 2001/0018908 | A1 | | 9/2001 | Joos et al. | |
| 2001/0023687 | A1 | | 9/2001 | Ushigome | |

* cited by examiner

*Primary Examiner*—Carl S. Miller
(74) *Attorney, Agent, or Firm*—Jimmy L. Funke

(57) ABSTRACT

An electronic returnless fuel system for a vehicle includes a fuel pump to pump fuel from a fuel tank. The electronic returnless fuel system also includes a fuel rail fluidly connected to the fuel pump to distribute the fuel to an engine of the vehicle and a pressure transducer to sense pressure of the fuel from the fuel pump to the fuel rail. The electronic returnless fuel system includes a controller electrically connected to the pressure transducer and the fuel pump to control the pressure of the fuel from the fuel pump to the fuel rail at a set operating pressure. The electronic returnless fuel system further includes a pressure relief valve interconnecting the fuel pump and the fuel rail set a predetermined amount below the set operating pressure to leak fuel back into the fuel tank.

17 Claims, 1 Drawing Sheet

ELECTRONIC RETURNLESS FUEL SYSTEM

CROSS-REFERENCE TO RELATED APPLICATION(S)

The present invention claims the priority date of copending U.S. Provisional Patent Application Ser. No. 60/214,509, filed Jun. 28, 2000.

TECHNICAL FIELD

The present invention relates generally to fuel systems for vehicles and, more particularly, to an electronic returnless fuel system for a vehicle.

BACKGROUND OF THE INVENTION

It is known to provide a mechanical returnless fuel system for a vehicle, which includes a fuel delivery module, a fuel filter, a fuel pressure regulator, a fuel rail, and fuel injectors. In the mechanical returnless fuel system, a fuel pump of the fuel delivery module typically runs at the maximum flow at all times to deliver fuel to an engine of the vehicle. When the engine of the vehicle is turned off, the heat from the engine continues to heat the fuel rail and causes the pressure in the fuel rail to rise. The increased pressure causes the fuel pressure regulator to open and relieve the pressure by dumping the heated fuel into the fuel tank, which generates vapor in the fuel tank.

It is also known to provide an electronic returnless fuel system for a vehicle, which eliminates the pressure regulator and the attendant fuel tank vapor formation by providing a pressure relief valve to relieve the pressure and by controlling the speed of the fuel pump. An example of such an electronic returnless fuel system is disclosed in U.S. Pat. No. 5,237,975 to Betki et al. In this patent, a returnless fuel delivery control system regulates fuel rail pressure at the level needed for precise control of fuel mass flow to fuel injectors at both normal and elevated engine temperatures. Other examples of returnless fuel systems are disclosed in U.S. Pat. Nos. 5,379,741, 5,448,977, and 5,848,583. However, these systems suffer from large pressure changes during transient flow and slow response characteristics.

It is desirable to provide a new electronic returnless fuel system for a vehicle that reduces vapor generation and heat input into the fuel tank. It is also desirable to provide an electronic returnless fuel system for a vehicle that reduces excess fuel being recirculated in the fuel tank. It is further desirable to provide an electronic returnless fuel system with pressure control, variable pressure, improved response characteristics, and reduced current of the fuel pump. Therefore, there is a need in the art to provide an electronic returnless fuel system that meets these desires.

SUMMARY OF THE INVENTION

It is, therefore, one object of the present invention to provide an electronic returnless fuel system for a vehicle.

It is another object of the present invention to provide an electronic returnless fuel system for a vehicle that minimizes pressure changes during transient flow conditions.

It is yet another object of the present invention to provide an electronic returnless fuel system for a vehicle that reduces vapor generation and heat input in a fuel tank for a vehicle.

To achieve the foregoing objects, the present invention is an electronic returnless fuel system for a vehicle including a fuel pump to pump fuel from a fuel tank. The electronic returnless fuel system also includes a fuel rail fluidly connected to the fuel pump to distribute the fuel to an engine of the vehicle and a pressure transducer to sense pressure of the fuel from the fuel pump to the fuel rail. The electronic returnless fuel system includes a controller electrically connected to the pressure transducer and the fuel pump to control the pressure of the fuel from the fuel pump to the fuel rail at a set operating pressure. The electronic returnless fuel system further includes a pressure relief valve interconnecting the fuel pump and the fuel rail set a predetermined amount below the set operating pressure to leak fuel back into the fuel tank.

One advantage of the present invention is that an electronic returnless fuel system is provided for a vehicle. Another advantage of the present invention is that the electronic returnless fuel system replaces the fuel pressure regulator with a pressure transducer and controls fuel pressure by controlling a fuel pump of the fuel delivery module. Yet another advantage of the present invention is that the electronic returnless fuel system minimizes pressure changes during transient flow conditions. Still another advantage of the present invention is that the electronic returnless fuel system operates more efficiently than a mechanical returnless fuel system. A further advantage of the present invention is that the electronic returnless fuel system allows gerotor fuel pumps to be used because the continuous leak allows the fuel pump to run at a rate that prevents a pumping section of the fuel pump from binding.

Other objects, features, and advantages of the present invention will be readily appreciated, as the same becomes better understood, after reading the subsequent description taken in conjunction with the accompanying drawings.

DESCRIPTION OF THE PREFERRED EMBODIMENT

Figure 1:
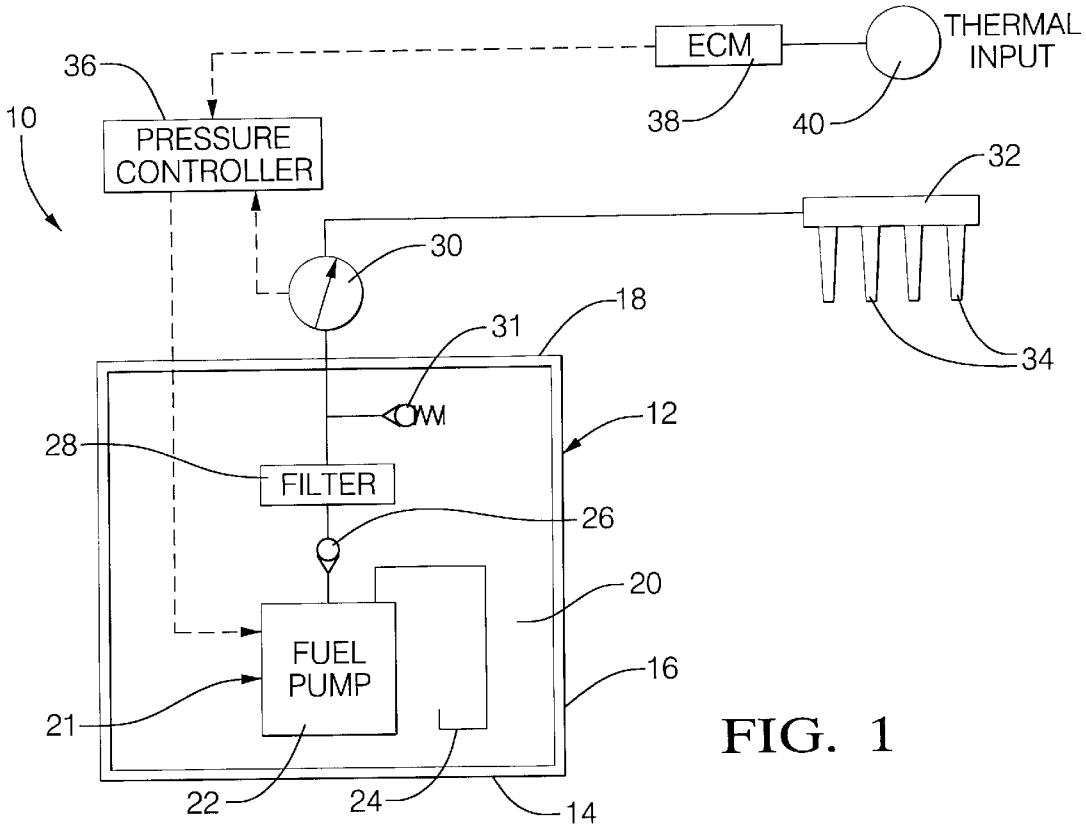
FIG. 1 is a diagrammatic view of an electronic returnless fuel system, according to the present invention.

Referring to the drawings and in particular FIG. 1, one embodiment of an electronic returnless fuel system 10, according to the present invention, is shown for a vehicle (not shown). The electronic returnless fuel system 10 is used with a fuel tank, generally indicated at 12, to hold liquid fuel. In this embodiment, the fuel tank 12 includes a bottom or base wall 14 and a side wall 16 around a periphery of the base wall 14 and extending generally perpendicular thereto. The fuel tank 12 also includes a top wall 18 extending generally perpendicular to the side wall 16 to form an interior chamber 20. The fuel tank 12 is made of a rigid material, preferably a plastic material. It should be appreciated that the fuel tank 12 could be made of a metal material such as steel.

The electronic returnless fuel system 10 includes a fuel delivery module, generally indicated at 21, to deliver fuel from the fuel tank 12. The fuel delivery module 21 includes a fuel pump 22 disposed in the interior chamber 20 of the fuel tank 12 to pump fuel therefrom. The fuel pump 22 is sized by the cold start requirements of the fuel system 10. The fuel delivery module 21 also includes a jet pump 24 disposed in the interior chamber 20 of the fuel tank 12 and fluidly connected to the fuel pump 22. The fuel delivery module 21 further includes a check valve 26 disposed in the interior chamber 20 of the fuel tank 12 and fluidly connected to the fuel pump 22 to allow only one-way fluid flow from the fuel pump 22. It should be appreciated that the check valve 26 may be part of the fuel pump 22. It should also be appreciated that the fuel pump 22, jet pump 24, and check valve 26 are conventional and known in the art.

The electronic returnless fuel system 10 also includes a fuel filter 28 disposed, preferably, in the interior chamber 20 of the fuel tank 12 and fluidly connected to the check valve 26 to filter contaminants in the fuel. The electronic returnless fuel system 10 also includes a pressure transducer 30 disposed, preferably, outside of the fuel tank 12 and fluidly connected to the fuel filter 28 to sense the pressure of the fuel from the fuel tank 12. The electronic returnless fuel system 10 further includes a pressure relief valve 31 disposed in the interior chamber 20 of the fuel tank 12 and fluidly interconnecting the fuel filter 28 and the pressure transducer 30. It should be appreciated that the fuel filter 28 may be disposed outside of the fuel tank 12 and the pressure transducer 30 may be disposed in the interior of the fuel tank 12. It should also be appreciated that the pressure relief valve 31 relieves pressure in the fuel system 10 when the engine of the vehicle is turned off and the engine heats the fuel in the fuel rail 32. It should further be appreciated that the pressure relief valve 31 prevents damage to the fuel system 10 due to over pressurization of the fuel. It should still further be appreciated that the fuel filter 28 and pressure relief valve 31 are conventional and known in the art.

The electronic returnless fuel system 10 also includes a fuel rail 32 fluidly connected to the pressure transducer 30 to distribute fuel to an engine (not shown) of the vehicle. The electronic returnless fuel system 10 also includes a plurality of fuel injectors 34 connected to the engine and fluidly connected to the fuel rail 32 to inject fuel into the engine. It should be appreciated that the check valve 26, fuel filter 28, pressure transducer 30, pressure relief valve 31, and fuel rail 32 are fluidly connected. It should also be appreciated that the fuel rail 32 and fuel injectors 34 are conventional and known in the art.

The electronic returnless fuel system 10 also includes an electronic controller 36 electrically connected to the fuel pump 22 and the pressure transducer 30. The electronic returnless fuel system 10 further includes an electronic control module (ECM) 38 electrically connected to the controller 36 and may include a thermal input 40 connected to the engine and electrically connected to the ECM 38. The ECM 38 selects and sets an operating pressure of the fuel system 10. The operating pressure may be based on the thermal input 40. The controller 36 receives the selected operating pressure from the ECM 38 and uses the input of fuel pressure from the pressure transducer 30 to create an error signal and generate a pulse width modulated (PWM) voltage that controls the speed of the fuel pump 22 to maintain the set operating pressure. It should be appreciated that the controller 36 may be a separate controller or some other controller in the vehicle such as the ECM 38, vehicle control module, body control module, etc.

In operation, liquid fuel in the interior chamber 20 of the fuel tank 12 is pumped by the fuel pump 22 through the check valve 26 and fuel filter 28, pressure transducer 30, fuel rail 32, and fuel injectors 34 into the engine. The electronic returnless fuel system 10 controls fuel pressure by controlling the fuel pump 22 by producing a pulse width modulated voltage closing loop on the set operating pressure and the feedback of the pressure transducer 30. The fuel pump 22 only pumps the amount of fuel needed to keep the fuel rail 32 at the desired or set operating pressure. It should be appreciated that vapor generation and heat input into the fuel tank 12 are reduced due to the elimination of the return line.

In a system without pressure relief, during engine deceleration/fuel cut off, the injectors 34 are shut off so that the fuel is trapped between the check valve 26 and the fuel rail 32. The pressure transducer 30 will sense the fuel pressure and the controller 36 will shutoff the fuel pump 22. When fuel is demanded again to the fuel injectors 34, the fuel pressure will drop as sensed by the pressure transducer 30 and the controller 36 will turn the fuel pump 22 back on. Because the fuel pump 22 was idle, there will be a significant pressure sag while the fuel pump 22 reaches operating speed.

In the present invention, the pressure relief valve 31 is set so that at approximately 5–10 kPa below the set operating pressure there is a small leak (2 to 6 grams/second) of fuel directly back into the interior chamber 20 of the fuel tank 12. This keeps the fuel pump 22 operating under all conditions. If the style of the fuel pump 22 has a maximum output pressure at a reduced voltage that is less than the set operating pressure of the fuel system 10, then a minimum voltage (typically 6 to 8 volts) is programmed so that the controller 36 will output to the fuel pump 22. The fuel pump 22 will continue to rotate, but not generate enough pressure to open the check valve 26. When the fuel injectors 34 open and the fuel pressure in the fuel line drops as sensed by the pressure transducer 30, the fuel pump 22 responds rapidly because it is already spinning. It should be appreciated that these different methods reduce the magnitude and duration of the sag, thus improving the response characteristic of the system 10 to a change in the fuel flow demand of the engine.

Figure 2:
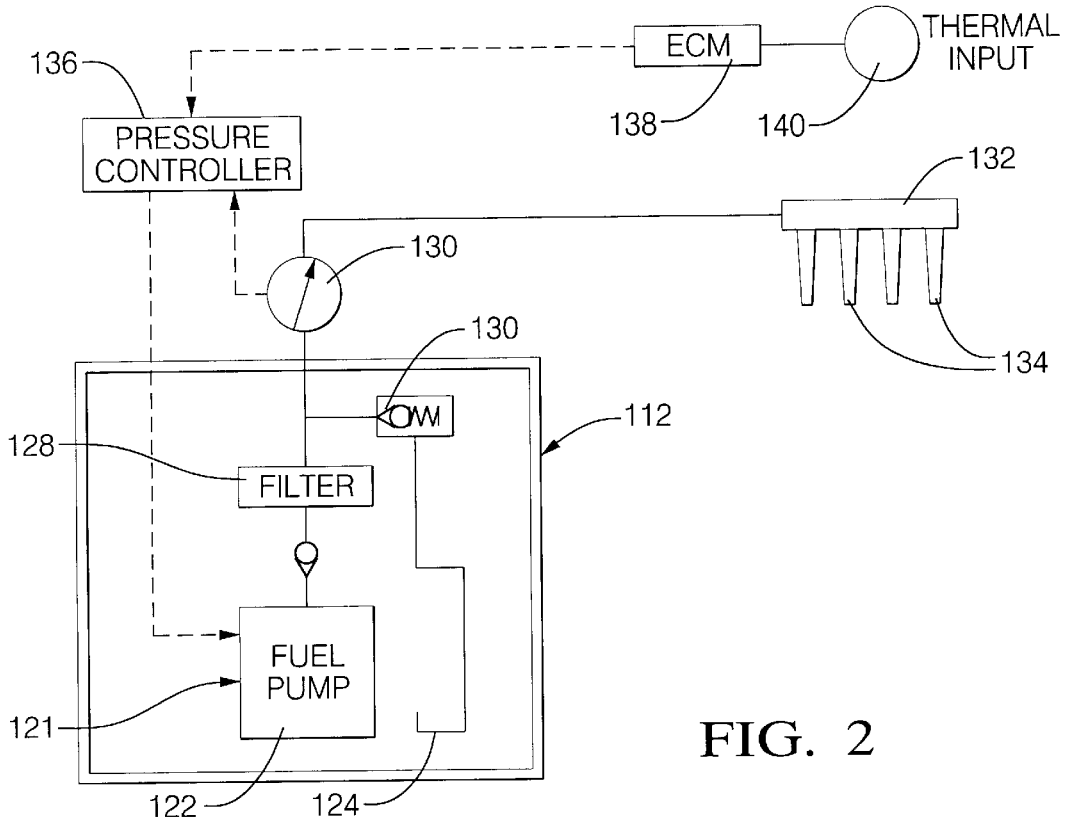
FIG. 2 is a diagrammatic view of another embodiment, according to the present invention, of the electronic returnless fuel system of FIG. 1.

Referring to FIG. 2, another embodiment, according to the present invention, of the electronic returnless fuel system 10 is shown. Like parts of the electronic returnless fuel system 10 have like reference numerals increased by one hundred (100). In this embodiment, the electronic returnless fuel system 110 includes the jet pump 124 of the fuel delivery module 121. The jet pump 124 is fluidly connected to the pressure relief valve 131, which may be fluidly connected before or after the fuel filter 128. The pressure relief valve 131 is set approximately 5 to 10 kPa lower than the operating pressure of the electronic returnless fuel system 110, but the output is ported to the jet pump 124. It should be appreciated that the pressure relief valve 131 is routed to the jet pump 124, which contains an orifice (not shown). It should also be appreciated that the size of the orifice determines the flow rate of fuel out of the pressure relief valve 131

In operation of the electronic returnless fuel system 110, the jet pump 124 does not use any fuel until the pressure relief valve 131 opens. This results in faster pressurization of the fuel system 110 at start-up. The orifice in the jet pump 124 limits the amount of fuel flow through the pressure relief valve 131. This is a benefit when the system 110 operates at multiple operating pressures. The pressure relief valve 131 is set at a value below the lowest operating pressure of the fuel system 110 and the orifice will minimize or limit the flow rate of fuel through the pressure relief valve 131 at higher operating pressures. It should be appreciated that the jet pump 124 does not bleed off fuel until the pressure relief valve 131 opens, which is a benefit for starting under low voltage conditions where the output of the fuel pump 122 is limited. It should also be appreciated that the jet pump 124 provides a continuous leak so that the fuel pump 121 runs under all conditions including deceleration fuel cut off, which enables quick fuel pump response when the operator actuates the throttle. It should further be appreciated that, if a large flow demand occurs and the fuel pump 122 cannot respond quickly enough, the pressure will drop, the pressure relief valve 131 will close, and the flow that was diverted to the jet pump 124 will be available to the engine, thereby minimizing the magnitude of the pressure sag. It should still further be appreciated that because the jet pump 124 is not using fuel until approximately system pressure is reached the fuel pump 122 does not have to supply the extra 3 g/s of fuel.

A benefit that occurs in both systems 10 and 110 is in the event of a rapid increase in fuel usage. If the fuel pump 22,122 cannot compensate for the increased fuel usage quick enough the pressure will drop below the value needed to keep the overpressure relief valve 31,131 open. When the overpressure relief valve 31,131 closes, the flow that was going through the valve 31,131 will now go to the engine. This additional 2 to 6 g/s of flow will limit the magnitude of the pressure sag, improving the response characteristic of the system 10,110. Once the fuel pump 22 is able to supply the demanded fuel the pressure will rise and the overpressure relief valve 31,131 will open again.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An electronic returnless fuel system for a vehicle comprising:

a fuel pump to pump fuel from a fuel tank;

a fuel rail fluidly connected to said fuel pump to distribute the fuel to an engine of the vehicle;

a check valve disposed in said fuel tank and interconnecting said fuel pump and said fuel rail;

a pressure transducer disposed between said check valve and said fuel rail to sense pressure of the fuel from said fuel pump to said fuel rail;

an electronic controller electrically connected to said pressure transducer and said fuel pump to control the pressure of the fuel from said fuel pump to said fuel rail at a set operating pressure; and a pressure relief valve disposed in the fuel tank and interconnecting said check valve and said fuel rail and set to open a predetermined amount below the set operating pressure to leak fuel back into the fuel tank when said fuel pump is operating.

2. An electronic returnless fuel system as set forth in claim 1 wherein said predetermined amount is approximately 5 kPa. to approximately 10 kPa.

3. An electronic returnless fuel system as set forth in claim 1 including a jet pump disposed in the fuel tank and fluidly connected to said pressure relief valve.

4. An electronic returnless fuel system as set forth in claim 1 including a jet pump disposed in the fuel tank and fluidly connected to said fuel pump.

5. An electronic returnless fuel system as set forth in claim 1 including an electronic control module electrically connected to said controller to set the operating pressure of said fuel system.

6. An electronic returnless fuel system for a vehicle comprising:

a fuel tank having an interior chamber;

a fuel pump disposed in said interior chamber of said fuel tank to pump fuel therefrom;

a fuel rail fluidly connected to said fuel pump to distribute the fuel to an engine of the vehicle;

a check valve disposed in said fuel tank and interconnecting said fuel pump and said fuel rail;

a fuel filter interconnecting said check valve and said fuel rail;

a pressure transducer disposed between said fuel filter and said fuel rail to sense pressure of the fuel between said fuel pump to said fuel rail;

an electronic controller electrically connected to said pressure transducer and said fuel pump to control the pressure of fuel to said fuel rail; and a pressure relief valve disposed in said fuel tank between said fuel filter and said pressure transducer and set to open a predetermined amount below the set operating pressure to leak fuel back into the fuel tank when said fuel pump is operating.

7. An electronic returnless fuel system as set forth in claim 6 wherein said predetermined amount is approximately 5 kPa. to approximately 10 kPa.

8. An electronic returnless fuel system as set forth in claim 6 including a jet pump disposed in said interior chamber and fluidly connected to said pressure relief valve.

9. An electronic returnless fuel system as set forth in claim 6 including a jet pump disposed in said interior chamber and fluidly connected to said fuel pump.

10. An electronic returnless fuel system as set forth in claim 6 including an electronic control module electrically connected to said controller to set an operating pressure of said fuel system.

11. A method of operating an electronic returnless fuel system for a vehicle, said method comprising the steps of:

pumping fuel from a fuel tank to an engine of the vehicle with a fuel pump;

sensing pressure of the fuel from the fuel pump to the fuel rail with a pressure transducer;

controlling the pressure of the fuel from the fuel pump to the fuel rail at a set operating pressure with an electronic controller electrically connected to the pressure transducer and the fuel pump; and setting a pressure relief valve interconnecting the fuel pump and the fuel rail to open at a predetermined amount below the set operating pressure to leak fuel back into the fuel tank when the fuel pump is operating.

12. A method as set forth in claim 11 including the step of continuously leaking fuel into the fuel tank by the jet pump.

13. A method as set forth in claim 11 wherein said step of setting comprises setting the pressure relief valve at approximately 5 kPa. to approximately 10 kPa. below the set operating pressure.

14. A method as set forth in claim 11 including the step of disposing a jet pump in the fuel tank and fluidly connecting the jet pump to the pressure relief valve.

15. A method as set forth in claim 14 including the step of opening the pressure relief valve and leaking fuel into the fuel tank by the jet pump.

16. A method as set forth in claim 14 including the step of continuously leaking fuel into the fuel tank by the jet pump.

17. A method as set forth in claim 14 including the step of closing the pressure relief valve if the pressure of the fuel drops below a value needed to keep the pressure relief valve open.

* * * * *